US006834769B2

(12) United States Patent
Takahashi et al.

(10) Patent No.: US 6,834,769 B2
(45) Date of Patent: Dec. 28, 2004

(54) HINGE CAP

(75) Inventors: Masami Takahashi, Tokyo (JP); Atsushi Oka, Osaka (JP); Yasuhiro Yamanaka, Higashi-Osaka (JP)

(73) Assignee: M.F.V Co., Ltd., Higashi-Osaka (JP)

( * ) Notice: Subject to any disclaimer, the term of this patent is extended or adjusted under 35 U.S.C. 154(b) by 54 days.

(21) Appl. No.: 10/110,769

(22) PCT Filed: Aug. 29, 2001

(86) PCT No.: PCT/JP01/07446

§ 371 (c)(1),
(2), (4) Date: Apr. 25, 2002

(87) PCT Pub. No.: WO02/22456

PCT Pub. Date: Mar. 21, 2002

(65) Prior Publication Data

US 2002/0148802 A1 Oct. 17, 2002

(30) Foreign Application Priority Data

Sep. 4, 2000 (JP) ..... 2000-267480

(51) Int. Cl.[7] ..... B65D 39/00
(52) U.S. Cl. ..... 215/235; 220/266; 222/153.01
(58) Field of Search ..... 215/235, 237, 215/238, 305; 220/266, 264; 222/153.01, 557, 562

(56) References Cited

U.S. PATENT DOCUMENTS

| | | | | | |
|---|---|---|---|---|---|
| 4,940,167 | A | * | 7/1990 | Fillmore et al. | 222/153.09 |
| 5,558,239 | A | * | 9/1996 | Dubach | 215/235 |
| 5,573,127 | A | * | 11/1996 | Takahashi et al. | 215/237 |
| 5,868,265 | A | * | 2/1999 | Kobayashi | 215/235 |

FOREIGN PATENT DOCUMENTS

| | | | |
|---|---|---|---|
| EP | 547978 | 6/1993 | |
| JP | 59-148708 | * 10/1984 | 215/237 |
| JP | 6-15844 | 4/1994 | |
| JP | 6-76094 | * 10/1994 | 215/237 |
| JP | 7-9747 | 2/1995 | |

* cited by examiner

*Primary Examiner*—Lien Ngo
(74) *Attorney, Agent, or Firm*—Oblon, Spivak, McClelland, Maier & Neustadt, P.C.

(57) ABSTRACT

A hinge cap having a preferable appearance irrespective of opening and closing of a cap cover, to facilitate a one-hand opening manipulation, and to prevent cost increase. In the hinge cap, a cap main body has a top plate, and most of a manipulation body for transmitting pushing force for opening the cap to the inside surface of an opening/closing hinge is covered even in a state that a cap cover is opened. Therefore, the hinge cap appearance is improved and the movement of the manipulation body does not deteriorate because the contents hardly leak into the movable portion of the manipulation body.

18 Claims, 11 Drawing Sheets

HINGE CAP

TECHNICAL FIELD

The present invention relates to a hinge cap that is used in a container such as a bottle for cosmetics.

BACKGROUND ART

As a cap that is used in a container such as a bottle for cosmetics, a hinge cap having a cap main body and a cap cover that can cover the top portion of the cap main body and is connected to the cap main body via an opening/closing hinge is now well known as exemplified by the fact that it is regarded as a prior art technique in Japanese Examined Utility Model Publication No. HEI 6-15844, for example.

Having the opening/closing hinge serving as a spring, this hinge cap is convenient in that when the cap cover is opened from a closed state by a prescribed degree the resilient force of the opening/closing hinge causes remaining opening action automatically, and that when the cap cover is closed from an open state by a prescribed degree the resilient force of the opening/closing hinge causes remaining closing action automatically. However, the amount of manipulation to be performed at the time of opening or closing is indefinite. There is inconvenience that an opening or closing attempt results in failure if a manipulation amount is insufficient.

To shut off water during closure, the engagement between the cap main body and the cap cover needs to be strong to some extent. This results in a problem that strong manipulation force is necessary at the time of opening to disengage the cap cover from the cap main body, requiring both hands eventually.

Hinge caps capable of solving the above problems are proposed in the above Japanese Examined Utility Model Publication No. HEI 6-15844, Japanese Unexamined Utility Model Publication No. HEI 7-9747/1995, etc.

In the hinge caps described in these publications, a slidable plate is provided on the top surface of the cap main body, and a tip portion of the plate is provided with a push button portion that projects outward from the closing interface between the cap main body and the cap cover.

Therefore, if the plate is slid into the hinge cap in a state that the cap cover is closed, the cap cover is pushed and opened (i.e., disengaged from the cap main body) through wedge action, and then the rear end portion of the plate pushes the opening/closing hinge from inside. In this manner, the cap cover can be opened by one hand.

In the conventional hinge caps, the plate is provided on the top surface of the cap main body. Therefore, when the cap cover is opened, the plate itself, detailed structures for supporting it when it slides, and other members are completely exposed to view, resulting in a bad appearance.

There is another problem that the contents of the container, for example, leak into the slide portion (movable portion) between the plate and the cap main body and accumulate on the plate. As a result the movement of the plate becomes worse gradually or the plate becomes prone to come off.

As an idea for solving the above problems, to provide cover as a separate member above the plate was suggested. However, this idea was not appropriate because it undesirably increases the number of parts, complicates the structure, and makes the assembling cumbersome, which lead to cost increase.

The present invention has been made in view of the above circumstances, and an object of the invention is therefore to provide a hinge cap which has a preferable appearance irrespective of opening and closing of a cap cover, facilitate a one-hand opening manipulation, and prevent cost increase.

DISCLOSURE OF THE INVENTION

To attain the above object, the present invention has taken the following measures.

That is, a hinge cap according to the invention has a cap main body, a cap cover that can cover a top portion of the cap main body and is connected to the cap main body via an opening/closing hinge, and a manipulation body that is incorporated in the cap main body so as to be used for a manipulation of opening the cap cover.

The opening/closing hinge may be integrated with the cap main body, integrated with the cap cover, or integrated with both of the cap main body and the cap cover so as to connect them.

The cap main body has a top plate capable of covering a main part of the manipulation body even in a state that the cap cover is opened, an outer circumferential wall provided along an outer circumference of the top plate, and an inner circumferential wall that is provided so as to form a circumferential space inside the outer circumferential wall and surround a contents flow path.

On the other hand, the manipulation body has a push button portion that is accommodated in the circumferential space under the top plate of the cap main body and is exposed to outside penetrating through the outer circumferential wall of the cap main body, and a pushing end for causing the cap cover to open when the push button portion is pushed.

With this configuration, most of the manipulation body (i.e., the portions excluding the push button portion) is made unseen and hence the appearance is improved.

Further, since the contents hardly leak into the movable portion between the manipulation body and the cap main body, the movement of the manipulation body is prevented from being deteriorated.

Alternatively, the manipulation body may have a pushing end that faces the opening/closing hinge squarely from inside, a push button portion that is positioned away from the opening/closing hinge and is exposed to outside of the cap main body, and a transmission rod that connects the pushing end and the push button portion in such a manner as to cause the pushing end to push the opening/closing hinge from inside when the push button portion is pushed.

The shape of the transmission rod is not restricted to specific ones. For example, the transmission rod may assume a ring shape that surrounds, and thereby clears the contents flow path provided in the cap main body or a curved rod shape that is obtained by omitting one of the two circular arc portions of the ring shape.

Such a transmission rod is made of a resilient material that enables storage of a force for pushing the opening/closing hinge during a manipulation stroke from a position where the pushing end abuts the opening/closing hinge to a position where the push button portion is pushed thereafter by a prescribed length.

With this configuration, the opening/closing hinge can be pushed all at once when the opening force has increased to a certain level, whereby the cap cover can be opened reliably. That is, an attempt to open the cap cover never fails and the operationality is increased.

Where the transmission rod is provided, pushing force that is exerted on the opening/closing hinge by the pushing end is distributed in a period from a start of pushing on the push button portion to disengagement of the cap cover form the cap main body and opening of the cap cover. As a result, no excess load acts on the opening/closing hinge, which leads to an advantage that the opening/closing hinge is prevented from being damaged.

It is preferable that the manipulation body be provided with an acting portion that abuts a proper portion of the cap cover before, at the same time as, or after the pushing end pushes the opening/closing hinge so as to transmit upward opening force to the cap cover in accordance with an increase in a pushing manipulation amount.

With this structure, an attempt to open the cap cover never fails and the manipulation of the cap is facilitated even in the case where the water shutoff effect in a state that the cap cover is closed is enhanced (i.e., in a case where strong engagement friction occurs against the cap main body).

According to a technical measure of the invention to solve the above technical problems, there is provided a hinge cap including a cap main body 2, a cap cover 3 that can cover a top portion of the cap main body 2 and is connected to the cap main body 2 via an opening/closing hinge 4, and a manipulation body 5 that is incorporated in the cap main body 2 and is used for a manipulation of opening the cap cover 3, wherein the cap main body 2 has a top plate 10 capable of covering a main part of the manipulation body 5 even in a state that the cap cover 3 is opened, an outer circumferential wall 11 provided along an outer circumference of the top plate 10, and an inner circumferential wall 12 provided inside the outer circumferential wall 11; and the manipulation body 5 has a push button portion 32 that is exposed to outside penetrating through the outer circumferential wall 11 of the cap main body 2, and a pushing end 34 for causing the cap cover 3 to open when the push button portion 32 is pushed, and the manipulation body 5 is accommodated under the top plate 10 between the outer circumferential wall 11 and the inner circumferential wall 12.

According to another technical measure of the invention, there is provided a hinge cap including a cap main body 2, a cap cover 3 that can cover a top portion of the cap main body 2 and is connected to the cap main body 2 via an opening/closing hinge 4, and a manipulation body 5 that is incorporated in the cap main body 2 and is used for a manipulation of opening the cap cover 3, wherein the manipulation body 5 has a pushing end 34, a push button portion 32 that is exposed to outside of the cap main body 2, and a transmission rod 33 that connects the pushing end 34 and the push button portion 32 so as to cause the pushing end 34 to push the opening/closing hinge 4 from inside when the push button portion 32 is pushed; and the transmission rod 33 is made of a resilient material so as to store a force for pushing the opening/closing hinge 4 during a manipulation stroke from a position where the pushing end 34 abuts the opening/closing hinge 4 to a position where the push button portion 32 is pushed thereafter by a prescribed length.

Another technical measure of the invention is such that the pushing end 34 of the manipulation body 5 is disposed so as to be opposed to the opening/closing hinge 4 from inside.

Another technical measure of the invention is such that the manipulation body 5 is provided with an acting portion 35 that abuts a proper portion of the cap cover 3 before, at the same time as, or after the pushing end 34 pushes the opening/closing hinge 4 and transmits upward opening force to the cap cover 3 in accordance with an increase in a pushing manipulation amount.

Another technical measure of the invention is such that the acting portion 35 is provided on a top surface of the push button portion 32 and the top surface of the push button portion 32 is inclined so as to descend toward the pushing end 34 side.

According to still another technical measure of the invention, there is provided a hinge cap including a cap main body 2, a cap cover 3 that can cover a top portion of the cap main body 2 and is connected to the cap main body 2 via an opening/closing hinge 4, and a manipulation body 5 that is incorporated in the cap main body 2 and is used for a manipulation of opening the cap cover 3, wherein the cap main body 2 has a top plate 10 capable of covering a main part of the manipulation body 5 even in a state that the cap cover 3 is opened, an outer circumferential wall 11 provided along an outer circumference of the top plate 10, and an inner circumferential wall 12 provided inside the outer circumferential wall 11;

the manipulation body 5 has a push button portion 32 that is exposed to outside penetrating through the outer circumferential wall 11 of the cap main body 2, a pushing end 34 disposed so as to be opposed to the opening/closing hinge 4 from inside, and a transmission rod 33 that connects the pushing end 34 and the push button portion 32 in such a manner as to cause the pushing end 34 to push the opening/closing hinge 4 and thereby cause opening action on the cap cover 3 when the push button portion 32 is pushed, and the manipulation body 5 is accommodated under the top plate 10 between the outer circumferential wall 11 and the inner circumferential wall 12; and the transmission rod 33 is made of a resilient material so as to store a force for pushing the opening/closing hinge 4 during a manipulation stroke from a position where the pushing end 34 abuts the opening/closing hinge 4 to a position where the push button portion 32 is pushed thereafter by a prescribed length.

Another technical measure of the invention is such that the cap main body 2, the cap cover 3, and the opening/closing hinge 4 are integral with each other and the manipulation body 5 is a separate member, and most of the manipulation body 5 is disposed under the top plate 10 between the outer circumferential wall 11 and the inner circumferential wall 12.

Another technical measure of the invention is such that a bottom portion of the inner circumferential wall 12 is provided with an inwardly projecting engagement nail 13 that is engaged with a bottom flange of a mouth 8 of a container 7.

Another technical measure of the invention is such that the top plate 10 of the cap main body 2 is provided with an output mouth 15 having a shape of a projecting pipe, and the cap cover 3 is provided with a mouth cap 19 that is detachably fitted with the output mouth 15.

Another technical measure of the invention is such that the outer circumferential wall 11 of the cap main body 2 is formed with a button through-hole 36 for allowing the push button portion 32 to pass through the outer circumferential wall 11.

Another technical measure of the invention is such that the transmission rod 33 has a ring shape so as to connect the push button portion 32 and the pushing end 34 of the cap main body 2 in two ways and to surround the inner circumferential wall 12, and the transmission rod 33 is accommodated between the outer circumferential wall 11 and the inner circumferential wall 12.

BEST MODE FOR CARRYING OUT THE INVENTION

Embodiments of the present invention will be hereinafter described with reference to the drawings.

FIGS. 1–7 show a hinge cap 1 according to a first embodiment of the invention.

Figure 1A:
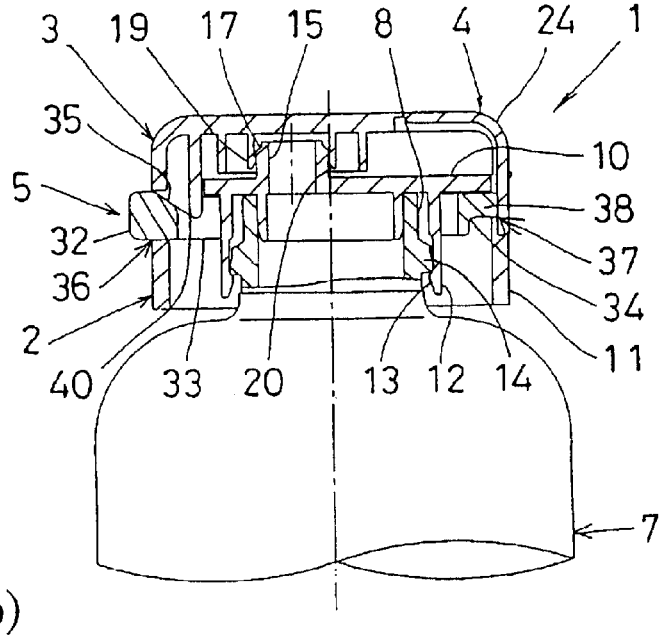
FIGS. 1(*a*) & (*b*) are a side sectional view and a bottom view of a hinge cap according to a first embodiment of the present invention that is in a closed state.
Figure 1B:
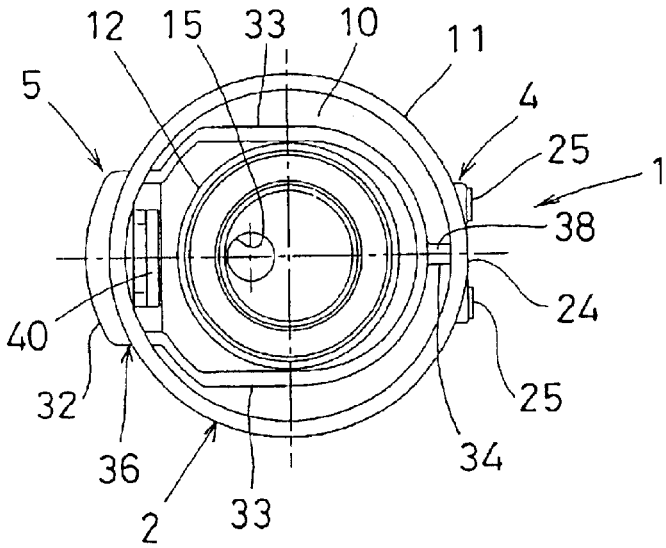
Figure 7:
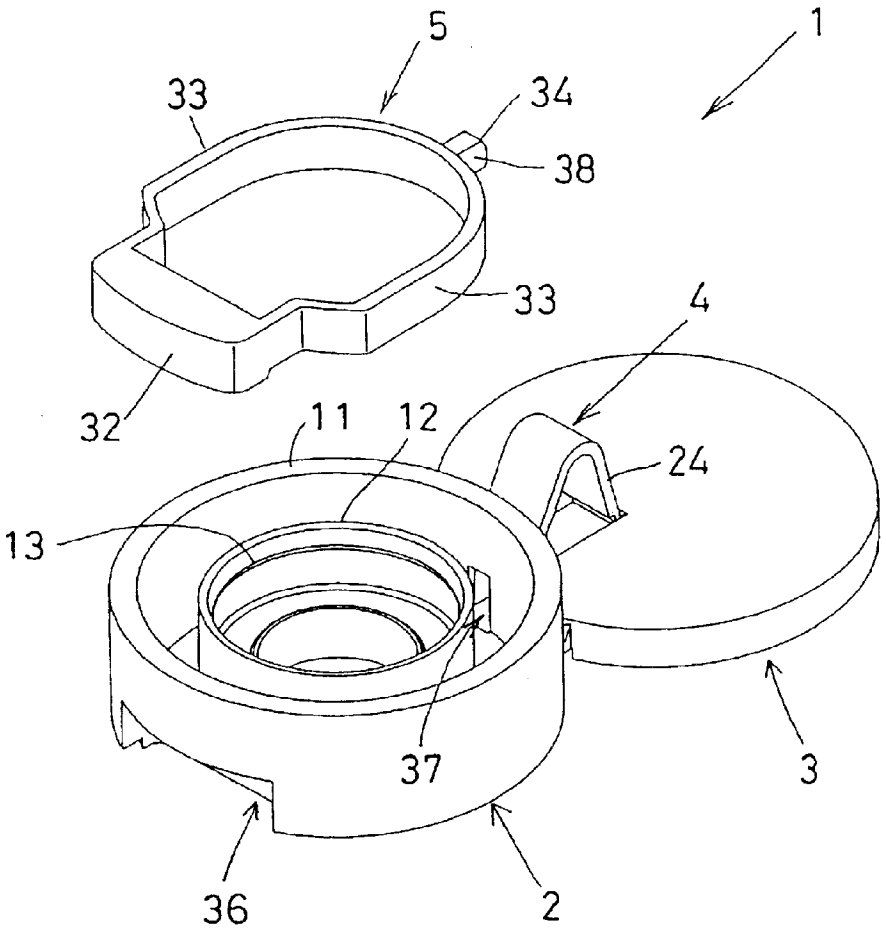
FIG. 7 is a perspective view as viewed from the back side showing the hinge cap according to the first embodiment of the invention in a disassembled state.

Among these drawings, FIGS. 1(*a*) & (*b*) show a closed state of the hinge cap 1. As an opening manipulation continues from the state of FIGS. 1(*a*) & (*b*), the state changes in order of FIGS. 2(*a*) & (*b*) and FIGS. (3(*a*) & (*b*). And FIGS. 4(*a*) & (*b*)–6 show a final open state (completely opened). FIG. 7 is an exploded view of the hinge cap 1 as viewed from the back side.

As seen from each of the above drawings, the hinge cap 1 has a cap main body 2, a cap cover 3, an opening/closing hinge 4, and a manipulation body 5.

In the first embodiment, three members that are the cap main body 2, the cap cover 3, and the opening/closing hinge 4 are integral with each other and only the manipulation body 5 is a separate member. Each of the integral body of the cap main body 2 etc. and the manipulation body 5 may be made of a proper synthetic resin material.

The cap main body 2 has a shape of a short cylinder having a bottom and being located upside down, as a whole, so as to be attached to a mouth 8 of a container 7 such as a bottle for cosmetics.

In this shape, a top plate 10 is a top circular plate, and an outer circumferential wall 11 is a side wall that vertically downwardly extends from an outer periphery of the top plate 10. An inner circumferential wall 12 is provided inside the outer circumferential wall 11 in such a manner that a circumferential space having a prescribed width is interposed therebetween.

The width of the circumferential space is not limited to a constant width. However, where the top plate 10 is planar and circular as in the case of the first embodiment, it is preferable, in terms of molding and combining with a container 7, that the circumferential space have a constant width to establish a concentric circle relationship between the outer circumferential wall 11 and the inner circumferential wall 12.

The inner circumferential wall 12 is provided with an inwardly projecting engagement nail 13 along its lower end. By engaging the engagement nail 13 with an engagement ring 14 that is provided around the mouth 8 of the container 7, the cap main body 2 (i.e., the entire hinge cap 1) can be attached to the container 7.

The top plate 8 is formed with a contents output mouth 15 in a plan-view range enclosed by the inner circumferential wall 12.

In other wards, the inner circumferential wall 12 encloses the contents flow path with the mouth 8 of the container 7 interposed therebetween.

The cap cover 3 has a shape of a reversed circular dish shape having approximately the same diameter as the diameter of the cap main body 2 which can cover the top portion of the cap main body 2.

In the first embodiment, the output mouth 15 having a shape of a projecting pipe is provided in the top plate 10 of the cap main body 2, and an engagement ring 17 is provided close to its projecting end. On the cap cover 3, as a structure corresponding to the above structure, a vertically downwardly extending cylindrical mouth cap 19 is formed to be fitted with the output mouth 15, and an inwardly projecting engagement nail 20 is formed along a lower end of the mouth cap 19 so as to correspond to the engagement ring 17.

An alternative structure (not shown) in which the mouth cap 19 is fitted into the output mouth 15 may be employed.

Therefore, when the cap main body 2 is covered with the cap cover 3 to establish a closed state, the mouth cap 19 is fitted with the output mouth 15 to provide a strong engagement therebetween, whereby an enhanced water shutoff effect can be obtained.

It goes without saying that the opening/closing hinge 4 pivotably connects the cap main body 2 and the cap cover 3. In a state that the cap cover 3 is closed, centers of the cap cover 3 and the cap main body 2 coincide with each other and, naturally, the output mouth 15 is fitted in the mouth cap 19.

In the first embodiment, the opening/closing hinge 4, which has a spring band 24 and auxiliary connecting portions 25 provided on both sides of the spring band 24, allows the cap cover 3 to be reversed in a state that the cap cover 3 is opened (completely) to such an extent (180° in the illustrated example) that the cap cover 3 does not become an obstacle when the contents flow through the output mouth 15 of the cap main body 2, as well as to maintain such a state.

The spring band 24 is formed to assume a hook (inverted-L) sectional shape by means of a cut 28 extending between the outer circumferential wall 11 of the cap main body 2 and the top surface of the cap cover 3 with its lower and upper ends connected to the cap main body 2 and the cap cover 3, respectively.

Figure 2A:
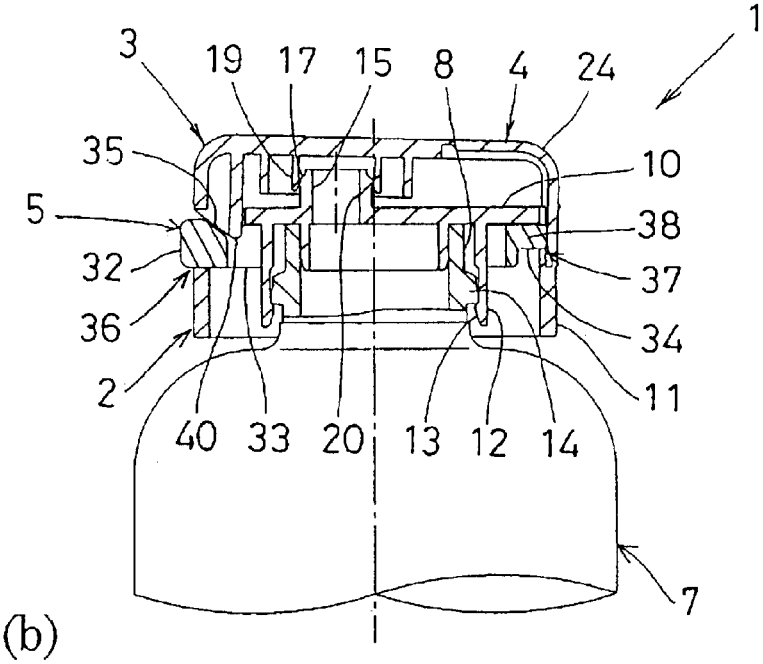
FIGS. 2(*a*) & (*b*) are a side sectional view and a bottom view showing a state immediately after an opening manipulation has been started from the state of FIGS. 1(*a*) & (*b*)
Figure 2B:
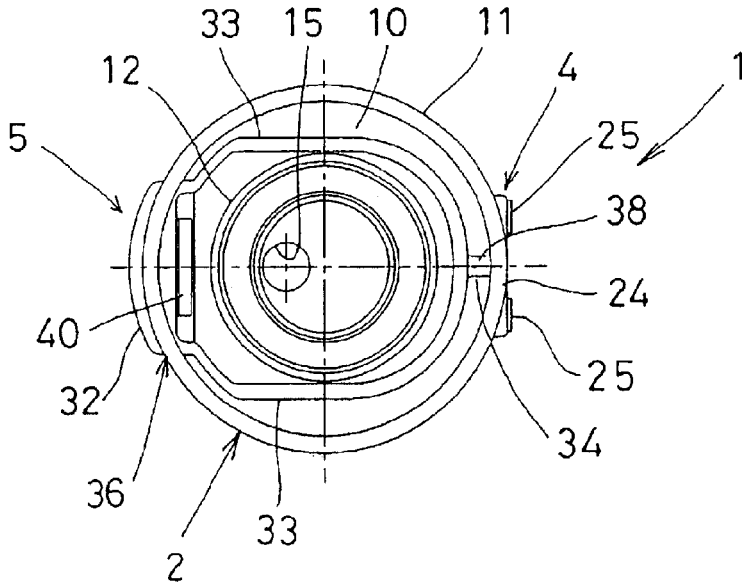
Figure 3A:
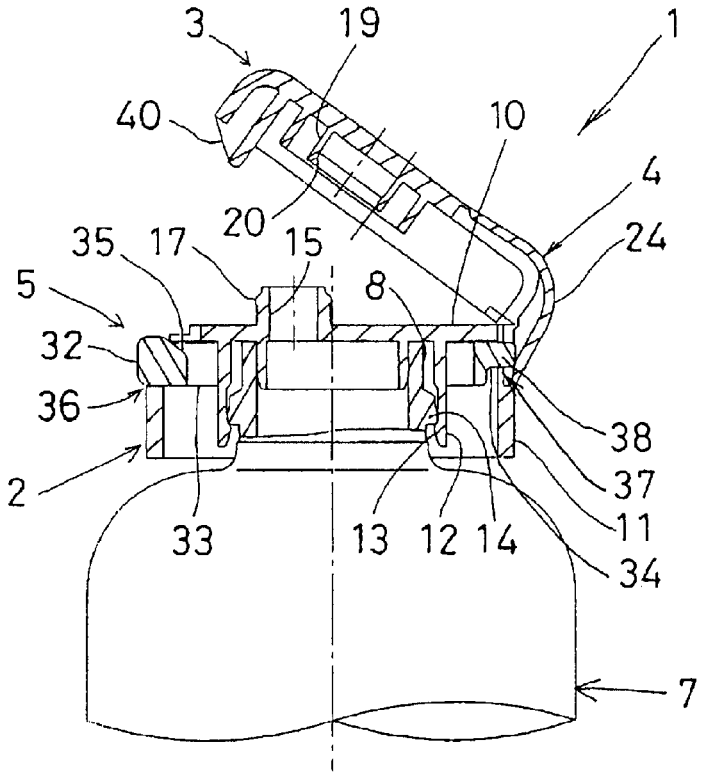
FIGS. 3(*a*) & (*b*) are a side sectional view and a bottom view showing a state that follows the state of FIGS. 2(*a*) & (*b*)
Figure 3B:
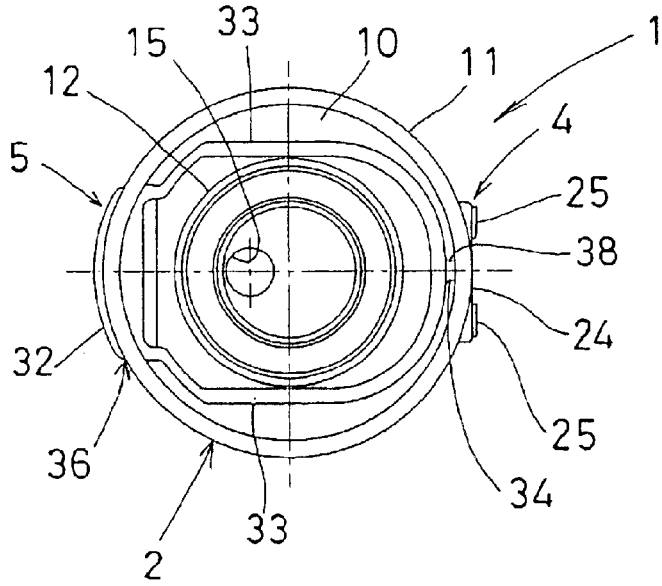
Figure 4A:
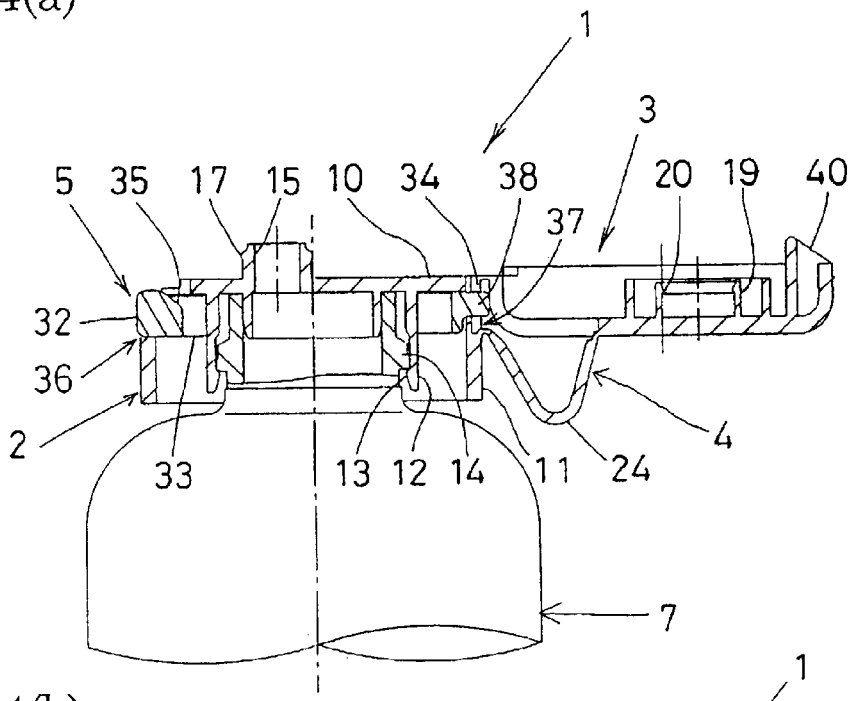
FIGS. 4(*a*) and (*b*) are a side sectional view and a bottom view showing an open state (completely opened) of the hinge cap according to the first embodiment of the invention.
Figure 4B:
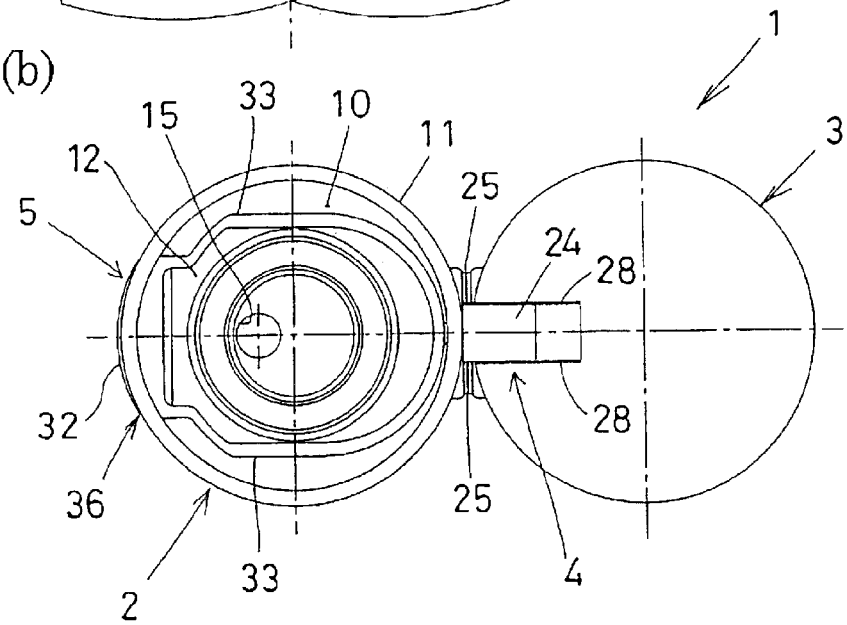
Figure 5:
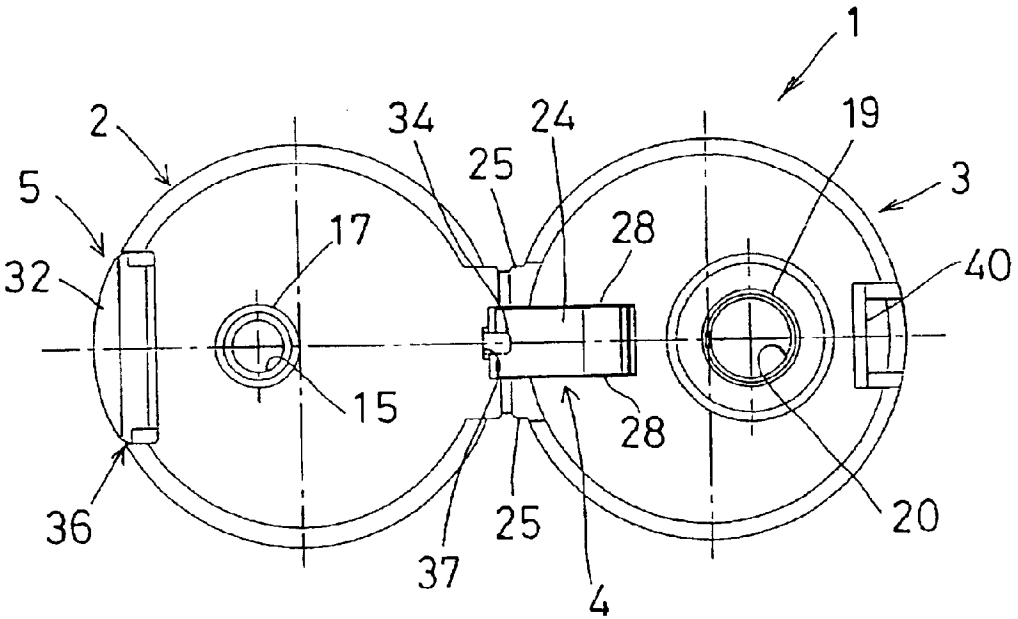
FIG. 5 is a plan view corresponding to FIGS. 4(*a*) & (*b*)
Figure 6:
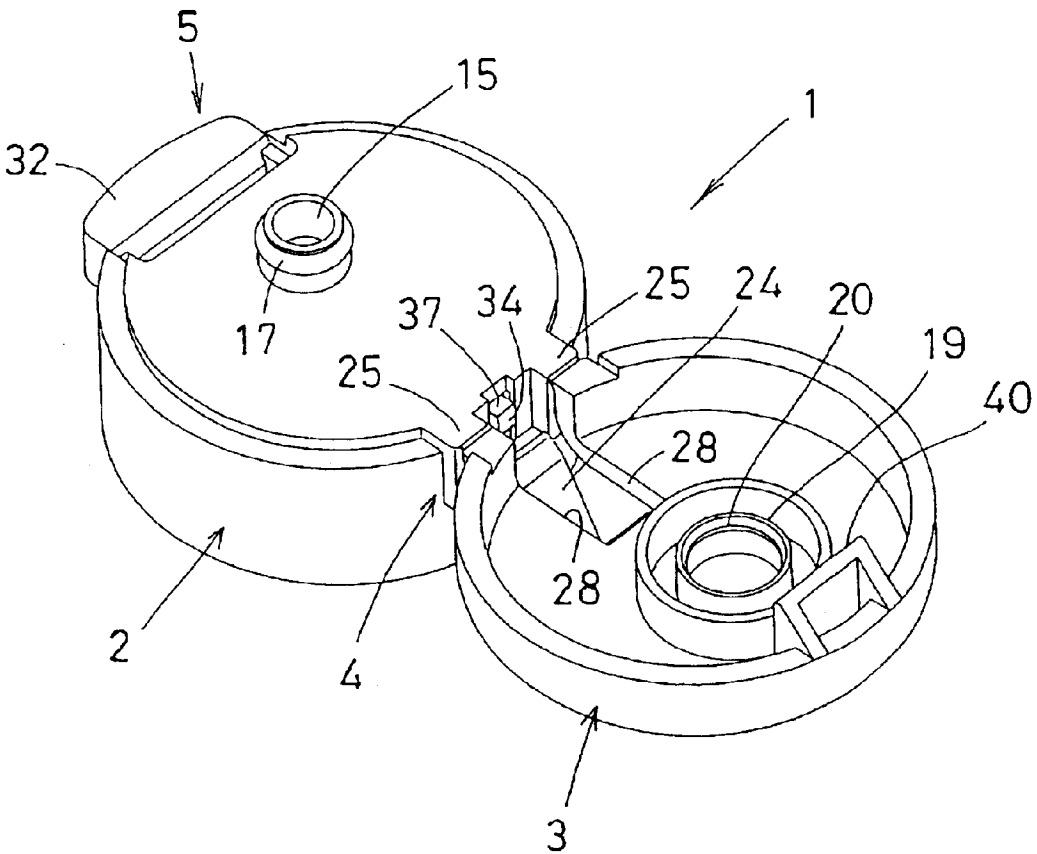
FIG. 6 is a perspective view corresponding to FIG. 5.

Therefore, if the spring band 24 is pushed from inside to outside in the radial direction (left to right in FIG. 1) at a position close to its lower end in a state that the cap cover 3 is closed (see FIG. 1), resilient force in the spring band 24 against the pushing force builds up as the pushed portion warps inward (see FIGS. 2 and 3). This resilient force urges the cap cover 3 in the closing direction until the angle of the cap cover 3 reaches a prescribed value. However, when the angle of the cap cover 3 has exceeded the prescribed value, the urging direction is reversed and the resilient force rotates the cap cover 3 in the opening direction. Finally, the resilient force almost disappears when the cap cover 3 is opened to a prescribed opening angle (see FIG. 4). As a result, the opening state of the cap cover 3 at this time is maintained.

The manipulation body 5 is incorporated in such a manner that most of the main part thereof is accommodated under the top plate 10 of the cap main body 2 to be used to perform a manipulation of opening the cap cover 3.

The manipulation body 5 has a push button portion 32, a transmission rod 33, a pushing end 34, and an acting portion 35.

The push button portion 32 penetrates through the outer circumferential wall 11 of the cap main body 2 and is exposed to outside. In terms of operationality and force transmission, it is preferable that the push button portion 32 be located as distant from the opening/closing hinge 4 as possible.

In the first embodiment, only one push button portion 32 is provided at such a position (front side of the container 7) that the push button portion 32 and the opening/closing hinge 4 are symmetrical. Therefore, the outer circumferential wall 11 of the cap main body 2 is formed with a button through-hole 36 at a position (front side) corresponding to the push button portion 32.

Although not shown in drawings, two push button portions 32 may be provided, for example, at right and left side positions of the cap main body 2.

The pushing end 34 is located in such a manner as to squarely face the spring band 24 of the opening/closing hinge 4 from inside. Therefore, the outer circumferential wall 11 of the cap main body 2 is formed with, at a corresponding position (right behind the pushing end 34), an acting end through-hole 37 for allowing the pushing end 34 to pass through it toward the inside surface of the opening/closing hinge 4.

In the first embodiment, the pushing end 34 has a chip-like projection 38. However, the invention is not limited to such a case including the projection 38; for example, the pushing end 34 may be unified with the transmission rod 33 as described later (without providing any definite shape as the pushing end 34).

In other wards, the pushing end 34 is provided for transmitting pushing force of the push button portion 32 to the opening/closing hinge 4 and thereby causing the cap cover 3 to open.

The transmission rod 33 connects the push button portion 32 and the pushing end 34.

In the first embodiment, the transmission rod 33 having a ring shape connects the push button portion 32 and the pushing end 34 in two ways.

That is, the transmission rod 33 which is completely accommodated in the circumferential space (between the outer circumferential wall 11 and the inner circumferential wall 12) of the cap main body 2 has a shape which surrounds the contents flow path provided in the cap main body 2 (inside the inner circumferential wall 12) so as not to contact and interfere with the flow path in the cap main body 2.

The transmission rod 33 having such a configuration is made of a resilient material (e.g., a resin or a metal) so as to cause a prescribed resilient force when an external force is applied to bend the transmission rod 33 in the longitudinal direction thereof.

The resilient material is required to have resilience to an extent that a force for pushing the opening/closing hinge 4 can be stored therein when the transmission rod 33 is bent during a manipulation stroke from a position where the pushing end 34 contacts the opening/closing hinge 4 to a position where the push button portion 32 is pushed thereafter by a prescribed length.

The transmission rod 33 having such resilience is capable of pushing the opening/closing hinge 4 all at once when a force for opening has increased to a certain level, whereby the cap cover 3 can be opened reliably.

The fact that the transmission rod 33 has a ring shape as described above is advantageous in that bend deformation of the transmission rod 33 is distributed to its right and left portions in a well-balanced manner (i.e., the ring shape of the transmission rod 33 is compressed in the longitudinal direction and expanded in the lateral direction while being kept symmetrical with respect to its center line) and hence the pushing end 34 is moved straightly.

With the above advantages, an attempt to open the cap cover 3 never fails and the manipulation of the cap is facilitated.

When the push button portion 32 is pushed to press the pushing end 34 against the opening/closing hinge 4, (before, at the same time as, or after the pushing) the acting portion 35 contacts a proper portion of the cap cover 3 and transmits upward opening force to the cap cover 3 in accordance with the increase in the amount of pushing manipulation on the push button portion 32.

Although the position of the acting portion 35 is not limited, the acting portion 35 in the first embodiment is provided on the top surface of the push button portion 32.

Specifically, the acting portion 35 is formed in such a manner that the top surface of the push button portion 32 is inclined so as to descend toward the pushing end 34 side.

Corresponding to the acting portion 35, a slide 40 projects downward from the cap cover 3 so as to be placed on the top portion of the acting portion 35 in a state that the cap cover 3 is closed. The bottom surface of the slide 40 is inclined in the same direction as the acting portion 35 is.

Therefore, a backward movement of the acting portion 35 causes cam action between the acting portion and the slide 40, which in turn causes wedge action for pushing up the cap cover 3.

With the above configuration, an attempt to open the cap cover 3 never fails and the manipulation of the cap is facilitated even when the water shutoff effect in a state that the cap cover 3 is closed is enhanced as described above.

In the hinge cap 1 having the above configuration, in a state that the cap cover 3 is closed (see FIG. 1), the mouth cap 19 is fitted with the output mouth 15 and strong engagement is caused therebetween to provide an enhanced water shutoff effect.

When the push button portion 32 is pushed in this state (see FIGS. 2 and 3), in the first stage, the pushing end 34 of the manipulation body 5 contacts the spring band 24 of the opening/closing hinge 4 from inside and the acting portion 35 contacts the slide 40.

As the push button portion 32 is pushed further, the pushing end 34 starts to push the spring band 24, the transmission rod 33 starts to store resilient force, and cam action between the acting portion 35 and the slide 40 transforms into wedge action.

As a result, the mouth cap 19 is lifted up and disengaged from the output mouth 15 and then the cap cover 3 is opened.

The cap cover 3 thus opened (see FIG. 4), enables the contents be taken out through the output mouth 15.

Of courase, such a manipulation of pushing the push button portion 32 can be performed by one hand.

In a state that the cap cover 3 is opened, since the main parts (excluding the push button portion 32) of the manipulation body 5 is covered almost completely with the top plate 10 of the cap main body 2, the manipulation body 5 cannot be seen and the appearance is made better as much.

Further, the contents hardly leak into the movable portion (the transmission rod 33 and its vicinity) between the manipulation body 5 and the cap main body 2, which prevents the movement of the manipulation body 5 from being deteriorated.

Figure 8:
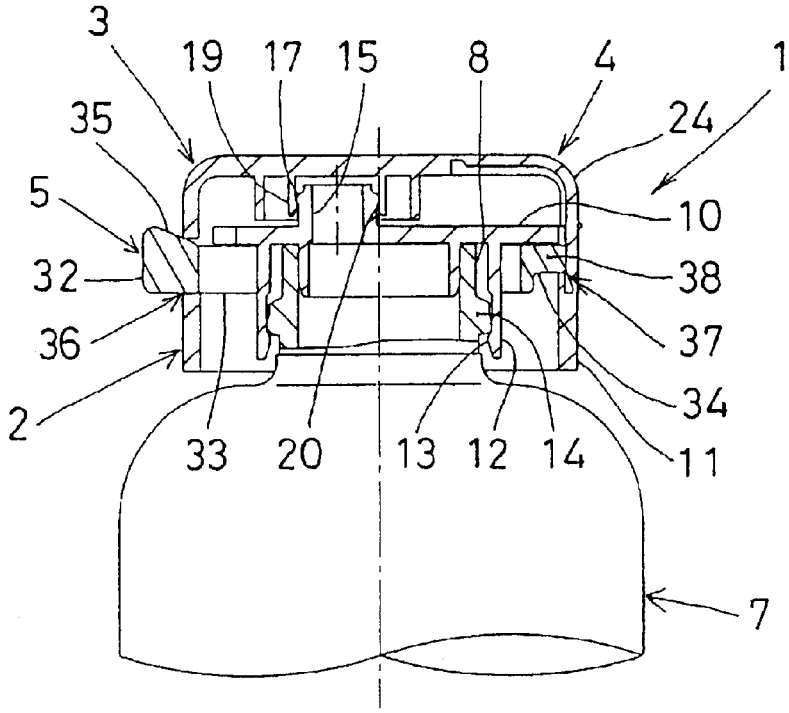
FIG. 8 is a side sectional view of a hinge cap according to a second embodiment of the invention that is in a closed state.

FIG. 8 shows a hinge cap 1 according to a second embodiment of the invention.

The hinge cap 1 according to the second embodiment is different from that according to the first embodiment in that the push button portion 32 of the manipulation body 5 has an increased thickness so that the acting portion 35 provided on the top surface thereof is located at an upper position, whereby necessary and sufficient cam action and wedge action on the cap cover 3 can be provided even if the cap cover 3 is not formed with the slide 40 expressly.

This provides an advantage that the structure of the cap cover 3 is simplified, which leads to cost reduction.

The other part of the configuration, the other detailed structures, the method of use, the various functions and effects, etc. are almost the same as in the first embodiment, and hence are not described here in detail.

Figure 9:
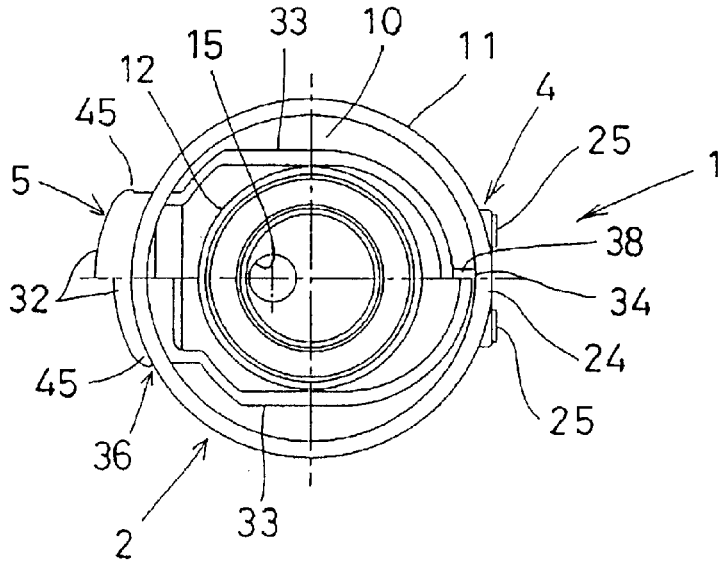
FIG. 9 is a back-side view (a bottom view) showing a hinge cap according to a third embodiment of the invention in which states before and after an opening manipulation are shown in the top half and the bottom half, respectively.

FIG. 9 shows a hinge cap 1 according to a third embodiment of the invention.

The hinge cap 1 according to the third embodiment is different from that according to the first embodiment in that the tip portion, exposed to the outside from the cap main body 2, of the push button portion 32 of the manipulation body 5 is formed with a stopper projection 45 that contacts the opening periphery of the button through-hole 36 when the push button portion 32 is pushed by a prescribed length.

Therefore, the pushing length of the push button portion 32 can be restricted by the stopper projection 45. This arrangement provides an advantage that damage to the manipulation body 5 and a phenomenon that the push button portion 32 goes out of place (i.e., the push button portion 32 is left in the cap main body 2 and does not return) due to excessive pushing can be prevented.

The other part of the configuration, the other detailed structures, the method of use, the various functions and effects, etc. are almost the same as in the first embodiment, and hence are not described here in detail.

Figure 10:
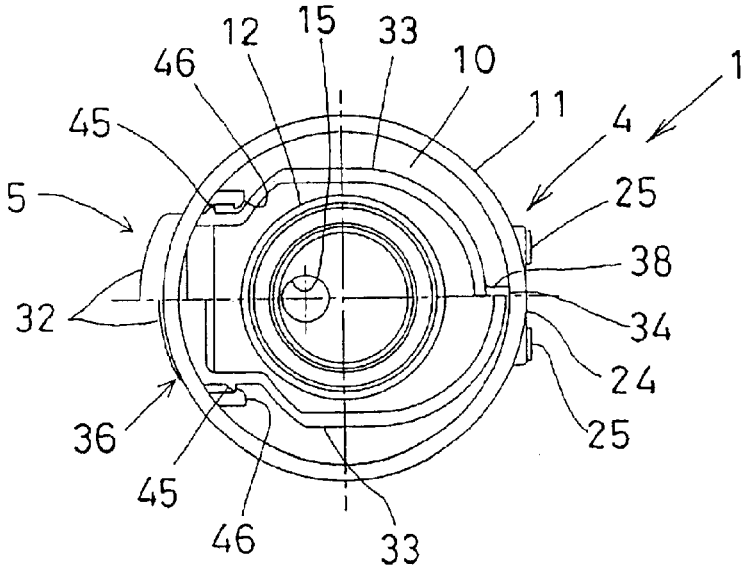
FIG. 10 is a back-side view (a bottom view) showing a hinge cap according to a fourth embodiment of the invention in which states before and after an opening manipulation are shown in the top half and the bottom half, respectively.

FIG. 10 shows a hinge cap 1 according to a fourth embodiment of the invention.

The hinge cap 1 according to the fourth embodiment is based on almost the same object as that according to the third embodiment, that is, it is intended to restrict the pushing length of the push button portion 32 and thereby prevent damage to the manipulation body 5 and a phenomenon that the push button portion 32 goes out of place (i.e., the push button portion 32 is left in the cap main body 2 and does not return) due to excessive pushing.

The fourth embodiment is different from the third embodiment in that the push button portion 32 of the manipulation body 5 is provided with a stopper projection 45 at a position close to the root thereof and inside the cap main body 2, and a stop nail 46 to engage the stopper projection 45 at a prescribed position is provided inside the cap main body 2.

Figure 11:
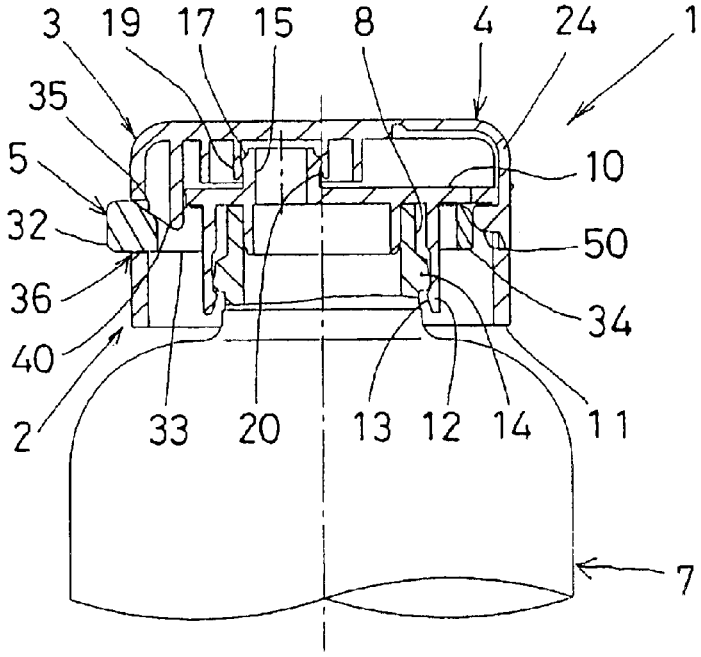
FIG. 11 is a side sectional view of a hinge cap according to a fifth embodiment of the invention that is in a closed state.

FIG. 11 shows a hinge cap 1 according to a fifth embodiment of the invention.

The hinge cap 1 according to the fifth embodiment is different from that according to the first embodiment in that the pushing end 34 of the manipulation body 5 is integrally formed with the transmission rod 33 (i.e., the pushing end 34 does not have an independently shaped portion as the chip-like projection 38 in the first embodiment).

However, since it is difficult to cause the pushing end 34 to contact the spring band 24 of the opening/closing hinge 4 unless some other structure is provided, in the fifth embodiment the cap cover 3 is provided with a pressure receiving portion 50 that projects toward the pushing end 34.

The other part of the configuration, the other detailed structures, the method of use, the various functions and effects, etc. are almost the same as in the first embodiment, and hence are not described here in detail.

Figure 12:
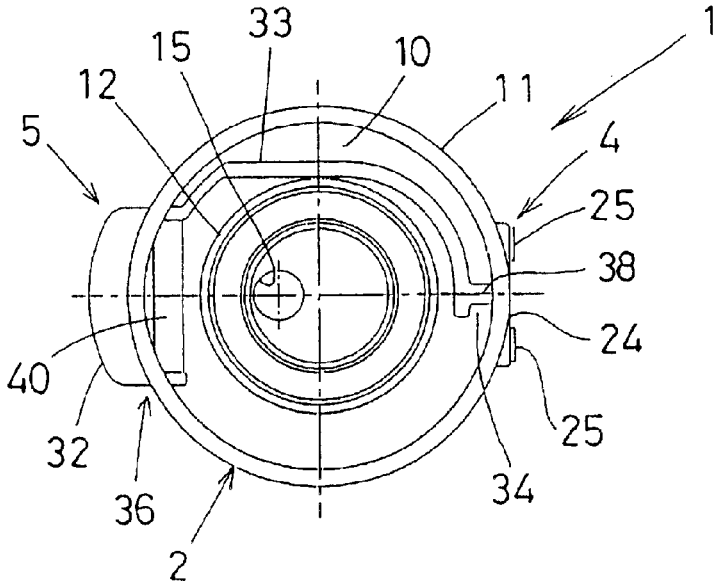
FIG. 12 is a bottom view of a hinge cap according to a sixth embodiment of the invention that is in a closed state.

FIG. 12 shows a hinge cap 1 according to a sixth embodiment of the invention.

The hinge cap 1 according to the sixth embodiment is different from that according to the first embodiment in that the manipulation body 5 has only one transmission rod 33 and the push button portion 32 is connected to the pushing end 34 in one way.

This provides an advantage that the structure of the manipulation body 5 is simplified, which leads to cost reduction.

The other part of the configuration, the other detailed structures, the method of use, the various functions and effects, etc. are almost the same as in the first embodiment, and hence are not described here in detail.

Figure 13:
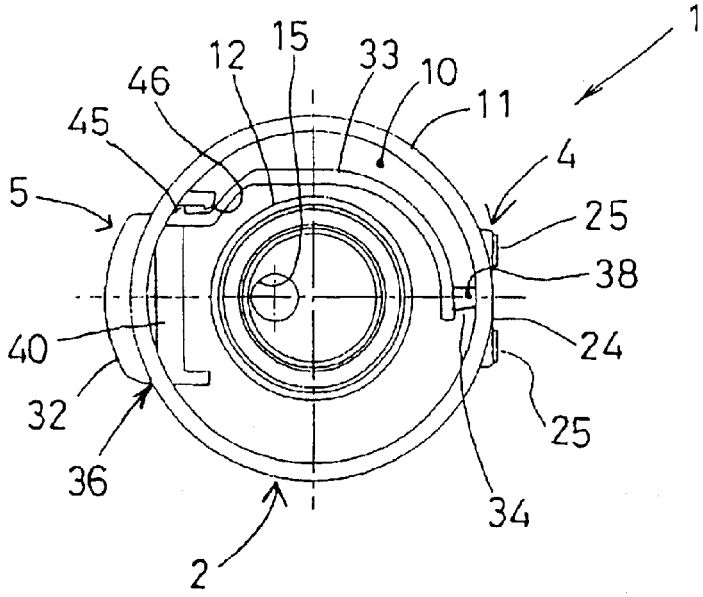
FIG. 13 is a bottom view of a hinge cap according to a seventh embodiment of the invention that is in a closed state.

FIG. 13 shows a hinge cap 1 according to a seventh embodiment of the invention.

Also in the hinge cap 1 according to the seventh embodiment, the manipulation body 5 has only one transmission rod 33.

Further, measures for restricting the pushing length of the push button portion 32 and thereby preventing damage to the manipulation body 5 and a phenomenon that the push button portion 32 goes out of place (i.e., the push button portion 32 is left in the cap main body 2 and does not return) due to excessive pushing are taken.

Specifically, the push button portion 32 is provided with a stopper projection 45 at a position close to the root thereof and inside the cap main body 2, and a stop nail 46 to engage the stopper projection 45 at a prescribed position is provided inside the cap main body 2.

Although not shown in drawings, the push button portion 32 of the manipulation body 5 may be provided on the tip portion thereof exposed to outside of the cap main body 2 with a stopper projection 45 so as to be abutted against the opening periphery of the button through-hole 36 when the push button portion 32 is pushed by a prescribed length (as seen in FIG. 9).

Incidentally, the invention is not limited to any of the above-described embodiments.

For example, the transmission rod 33 of the manipulation body 5 may be made of an unresilient material (e.g., rigid plastics or a hard metal).

In this case, when the push button portion 32 is pushed further from a state that the mouth cap 19 has been lifted up and disengaged from the output mouth 15 as a result of pushing on the push button portion 32, the pushing end 34 abuts the spring band 24 of the opening/closing hinge 4 from inside. That is, this action does not store pushing force (resilient force) in the transmission rod 33.

The materials of the cap main body 2 etc. are not limited to synthetic resins. Part or all of them may be made of a metal such as aluminum or stainless steel, glass, or the like.

The plan-view external shapes of the cap main body 2 etc. and container 7 are not limited to an ellipse, a circle, and the like, and may be modified so as to assume a rectangular shape, for example.

Other modifications to the embodiments can be made as appropriate.

As is apparent from the above description, in the hinge cap according to the invention, the cap main body has the deck portion and most of the manipulation body for transmitting pushing opening force to the inside surface of the opening/closing hinge is covered even in a state that the cap cover is opened. Therefore, the appearance is improved and the movement of the manipulation body does not deteriorate because the contents hardly leak into the movable portion of the manipulation body.

Further, since the transmission rod of the manipulation body is made of a resilient material, the opening/closing hinge can be pushed by strong force all at once, which provides an advantage that the cap cover can be opened easily and reliably.

Industrial Applicability

The present invention is useful as a cap that is used in a container such as a bottle for cosmetics.

What is claimed is:

1. A hinge cap comprising:

a cap main body;

a cap cover configured to cover a top portion of the cap main body and connected to the cap main body by an opening/closing hinge; and a manipulation body incorporated in the cap main body to be used for a manipulation of opening the cap cover;

the cap main body comprising:

a top plate formed with an output mouth;

an outer circumferential wall provided along an outer circumference of the top plate; and an inner circumferential wall extending from the top plate and integrally formed with the outer circumferential wall, the manipulation body comprising:

a push button portion exposed to outside penetrating through the outer circumferential wall of the cap main body; and a pushing end for causing the cap cover to open when the push button portion is pushed, wherein a portion of the manipulation body is accommodated under the top plate between the outer circumferential wall and the inner circumferential wall, and the top plate is configured to cover a main part of the manipulation body even in a state that the cap cover is opened.

2. A hinge cap comprising:

a cap main body;

a cap cover configured to cover a top portion of the cap main body and connected to the cap main body by an opening/closing hinge; and a manipulation body incorporated in the cap main body to be used for a manipulation of opening the cap cover;

the can main body comprising:

a top plate formed with an output mouth;

an outer circumferential wall provided along an outer circumference of the top plate; and an inner circumferential wall extending from the top plate, provided inside the outer circumferential wall and integrally formed therewith;

the manipulation body comprising:

a pushing end;

a push button portion exposed to outside penetrating through the outer circumferential wall of the cap main body; and a transmission rod connecting the pushing end and the push button portion to cause the pushing end to push the opening/closing hinge from inside when the push button portion is pushed;

the transmission rod being made of a resilient material to store a force for pushing the opening/closing hinge during a manipulation stroke from a position where the pushing end contacts the opening/closing hinge to a position where the push button portion is pushed thereafter by a prescribed length, the pushing end and the transmission rod of the manipulation body being accommodated under the top plate between the outer circumferential wall and the inner circumferential wall, the top plate being configured to cover a main part of the manipulation body even in a state that the can cover is opened.

3. A hinge cap according to claim 2, wherein the pushing end of the manipulation body is disposed to be opposed to the opening/closing hinge from inside.

4. A hinge cap according to claim 2, wherein the manipulation body is provided with an acting portion that contacts a proper portion of the cap cover before, at a same time as, or after the pushing end pushes the opening/closing hinge and transmits upward opening force to the cap cover in accordance with an increase in a pushing manipulation amount.

5. A hinge cap according to claim 3, wherein an acting portion is provided on a top surface of the push button portion, and the top surface of the push button portion is inclined to descend toward the pushing end side.

6. A hinge cap according to claim 4, wherein the acting portion is provided on a top surface of the push button portion, and the top surface of the push button portion is inclined to descend toward the pushing end side.

7. A hinge cap comprising:

a cap main body;

a cap cover configured to cover a top portion of the cap main body and connected to the cap main body by an opening/closing hinge; and a manipulation body being incorporated in the cap main body to be used for a manipulation of opening the cap cover;

the cap main body comprising:

a top plate formed with an output mouth;

an outer circumferential wall provided along an outer circumference of the top plate; and an inner circumferential wall extending from the top plate, provided inside the outer circumferential wall and integrally formed therewith;

the manipulation body comprising:

a push button portion exposed to outside penetrating through the outer circumferential wall of the cap main body;

a pushing end disposed to be opposed to the opening/closing hinge from inside; and a transmission rod connecting the pushing end and the push button portion to cause the pushing end to push the opening/closing hinge and thereby cause opening action on the cap cover when the push button portion is pushed, wherein a portion of the manipulation body being accommodated under the top plate between the outer circumferential wall and the inner circumferential wall, the top plate is configured to cover a main part of the manipulation body even in a state that the cap cover is opened, and the transmission rod is made of a resilient material to store a force for pushing the opening/closing hinge during a manipulation stroke from a position where the pushing end contacts the opening/closing hinge to a position where the push button portion is pushed thereafter by a prescribed length.

8. A hinge cap according to claim 7, wherein the cap main body, the cap cover, and the opening/closing hinge are integral with each other and the manipulation body is a separate member, and most of the manipulation body is disposed under the top plate between the outer circumferential wall and the inner circumferential wall.

9. A hinge cap according to claim 7, wherein a bottom portion of the inner circumferential wall is provided with an inwardly projecting engagement nail for engaging with a bottom flange of a mouth of a container.

10. A hinge cap according to claim 7, wherein the top plate of the cap main body is provided with an output mouth having a shape of a projecting pipe, and the cap cover is provided with a mouth cap detachably fitted with the output mouth.

11. A hinge cap according to claim 7, wherein the outer circumferential wall of the cap main body is formed with a button through-hole configured to allow the push button portion to pass therethrough.

12. A hinge cap according to claim 7, wherein the transmission rod has a ring shape connecting the push button portion and the pushing end of the cap main body in two ways and surrounding the inner circumferential wall, and the transmission rod is accommodated between the outer circumferential wall and the inner circumferential wall.

13. The hinge cap of claim 1, wherein said push button protrudes outside said outer circumferential wall.

14. The hinge cap of claim 13, wherein an external area of said push button is flush with said outer circumferential wall.

15. The hinge cap of claim 2, wherein said push button protrudes outside said outer circumferential wall.

16. The hinge cap of claim 15, wherein an external area of said push button is flush with said outer circumferential wall.

17. The hinge cap of claim 7, wherein said push button protrudes outside said outer circumferential wall.

18. The hinge cap of claim 17, wherein an external area of said push button is flush with said outer circumferential wall.

* * * * *